United States Patent [19]

Persing et al.

[11] Patent Number: 5,057,039

[45] Date of Patent: Oct. 15, 1991

[54] ELECTRICAL OR COMMUNICATIONS MONUMENT FOR MOUNTING ALONG AN EDGE OF A WORK SURFACE

[75] Inventors: Brian J. Persing, Northgate; Philip C. Banas, Park Township, Ottawa County; Timothy J. Wiersma, Wyoming; John P. Connor, Jamestown Township, Ottawa County; James R. Bouse, Belmont, all of Mich.

[73] Assignee: Westinghouse Electric Corp., Pittsburgh, Pa.

[21] Appl. No.: 637,722

[22] Filed: Jan. 7, 1991

[51] Int. Cl.[5] ..... H01R 13/60

[52] U.S. Cl. ..... 439/574; 248/231.7; 439/535

[58] Field of Search ..... 439/535, 538, 539, 563, 439/565, 579, 575; 248/51, 117.1, 225.31, 231.7, 300; 38/142; 219/297

[56] References Cited

U.S. PATENT DOCUMENTS

| | | | |
|---|---|---|---|
| 2,271,463 | 1/1942 | Reeves | 435/535 |
| 2,714,650 | 8/1955 | Wierner | 219/247 |
| 2,937,837 | 5/1960 | Johnson | 248/300 |
| 3,006,589 | 10/1961 | Drysdale | 248/51 X |
| 3,535,508 | 10/1970 | Warshauser | 248/231.7 X |
| 3,966,158 | 6/1976 | Boundy . | |
| 4,828,513 | 5/1989 | Morrison et al. . | |

*Primary Examiner*—Eugene F. Desmond

[57] ABSTRACT

An electrical or communications monument for selective mounting along an edge of a work surface which may have a predetermined minimum spacing between the edge and an adjacent obstruction. The monument includes a one-piece bracket having a back portion from which a base and first and second spaced support arms extend. The base joins the back portion with a curved section which has a predetermined relative large radius. The back portion extends above the support arms to provide a flange upon which a receptacle is mounted. The curved section enables the bracket to be mounted along an edge of a work surface, notwithstanding a closely spaced wall, with the support arms resting upon the work surface. A screw is threadedly engaged with the base. Engagement of the screw with the lower side of the work surface provides a firm three-point support for the monument.

6 Claims, 2 Drawing Sheets

ELECTRICAL OR COMMUNICATIONS MONUMENT FOR MOUNTING ALONG AN EDGE OF A WORK SURFACE

TECHNICAL FIELD

The invention relates in general to electrical and communication monuments, and more specifically to electrical and communication monuments which may be quickly and easily mounted along an edge of a work surface, and just as quickly removed.

BACKGROUND ART

Monuments are commercially available which bring electrical receptacles and communications data ports in close proximity to a user's work surface. Such monuments typically require either an opening in the work surface within which a monument is mounted, or a special rear-mounted trough to which the monument is attached. The opening requires that the monument be located at a specific location, which may not be the most convenient location for the apparatus to be plugged into the monument. The special rear-mounted trough adds additional expense to the work surface.

It would be desirable, and it is an object of the present invention, to provide an electrical or communications monument which may be quickly and easily attached along a selected edge of a work surface, notwithstanding that the selected edge may be relatively close to an obstruction, such as a wall.

SUMMARY OF THE INVENTION

Briefly, the present invention is an electrical or communications monument for selective mounting along a back or side edge of a work surface, which edge may be spaced as close as about three-eights of an inch (0.375") from an obstruction, such as a wall. The monument includes a one-piece bracket having a back portion from which a base and first and second spaced support arms extend. The first and second support arms each include a resilient pad on lower surfaces thereof. The base, which has a threaded opening for receiving a screw, joins the back portion via a curved section which has a predetermined relative large radius. The radius is selected according to the thickness of the associated work surface and a minimum spacing between the selected edge and an obstruction. For example, if the back edge of a work surface is spaced about three-eights of an inch from a wall (0.375"), and the work surface is about one inch (1.0") to one and one-quarter inches (1.25") thick, the predetermined radius would be about seven eights of an inch (0.875").

The back portion continues to extend above the first and second spaced support arms to provide a flange upon which electrical or communication receptacles are mounted, as desired. In a preferred embodiment the receptacle mounting flange is notched, starting from an upper edge of the flange and extending to the curved portion, to provide space for an electrical cord or communications cable which depends from the receptacle.

The monument may be easily mounted along a selected edge, which may be as close as about three-eights of an inch (0.375") from an obstruction, by a simple downward rotational action which moves the base and curved section in close proximity to the selected edge, to a position below a lower side of the work surface. With the first and second support arms resting on the upper side of the work surface, a screw is engaged with the threaded opening in the base and it is advanced until the end of the screw firmly engages the lower side of the work surface. This action compresses the resilient pads which are now between the first and second support arms and the upper side of the work surface, to provide a firm three-point holding action which enables the monument to resist twisting when an electrical or communications plug is inserted into the monument's receptacle.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
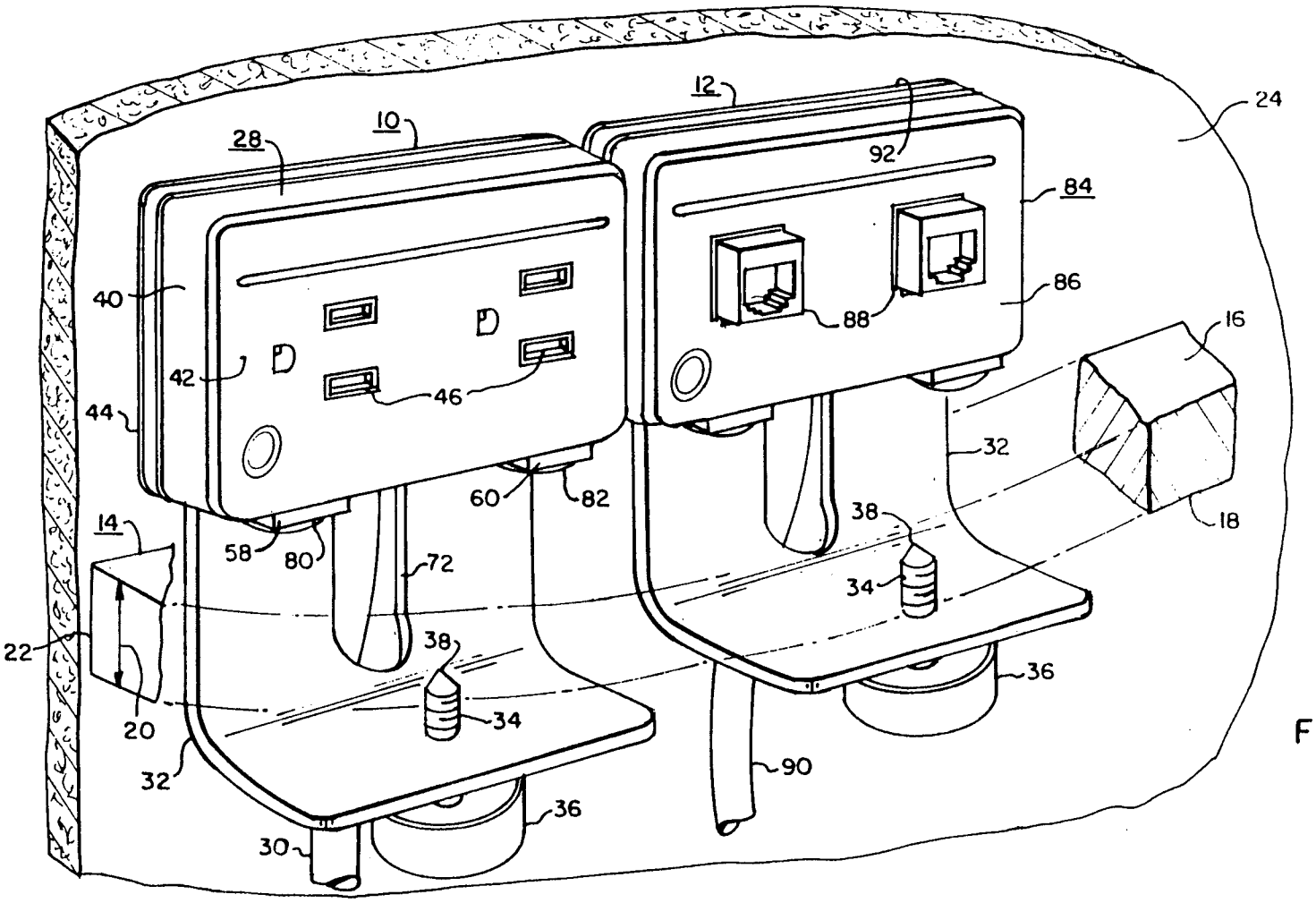
FIG. 1 is a perspective view of electrical and communication monuments constructed according to the teachings of the invention, mounted side-by-side on an edge of a work surface.

Referring now to the drawings, and to FIG. 1 in particular, there is shown in perspective an electrical monument 10 and a communication monument 12 constructed according to the teachings of the invention. Monuments 10 and 12 are clamped to a work surface 14 having upper and lower sides 16 and 18, a predetermined thickness dimension 20 between the upper and lower sides, and a plurality of perimetrical edges, such as edge 22. As illustrated, edge 22 may be disposed closely adjacent to an obstruction, such as a wall 24. At least a portion of edge 22 must be spaced a predetermined minimum dimension 26, shown in FIG. 3, from the wall 24.

Figure 2:
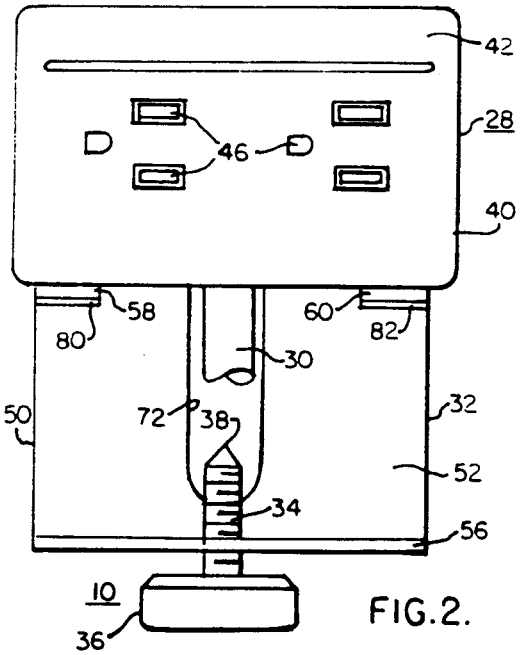
FIG. 2 is a front elevational view of the electrical monument shown in FIG. 1.
Figure 4:
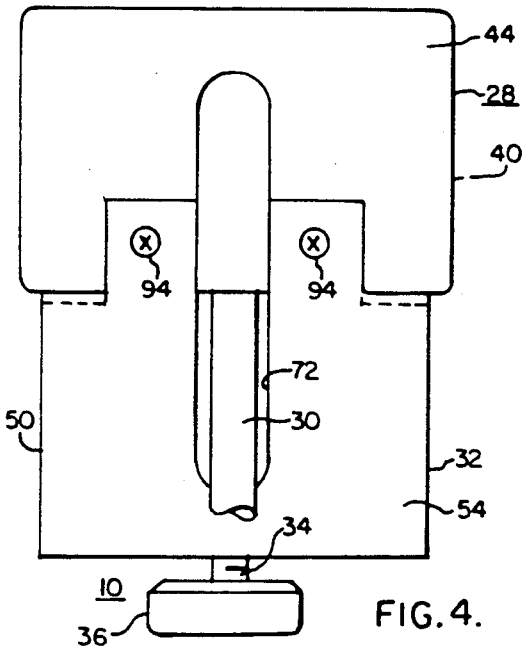
FIG. 4 is a rear elevational view of the electrical monument shown in FIGS. 1 and 2.
Figure 3:
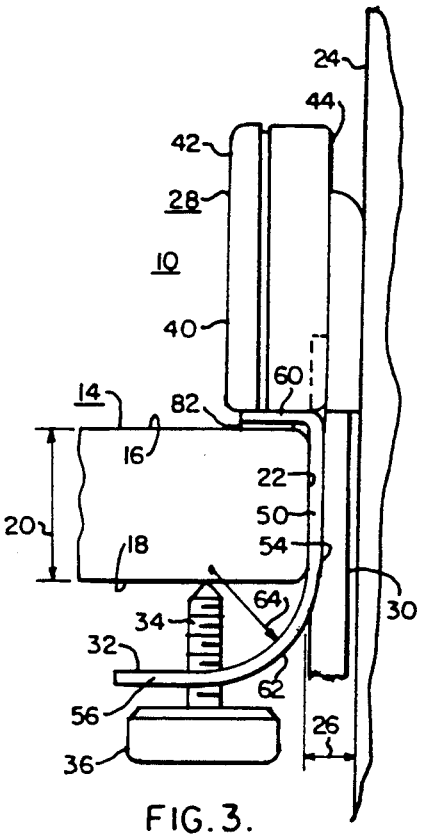
FIG. 3 is a side elevational view of the electrical monument shown in FIGS. 1 and 2.

Electrical monument 10, which is also shown in front, side and rear elevational views in FIGS. 2, 3 and 4, respectively, includes an electrical receptacle 28, which may be a duplex as illustrated, a simplex, or any other arrangement, a power cord 30 with a NEMA standard electrical plug (not shown), a bracket 32, and a screw 34 having a large knob 36 on one end and a sharp point 38 on the other.

Receptacle 28 includes a plastic housing 40 having front and back sides 42 and 44, and electrical contacts or terminals therein which are accessible via appropriate openings 46 on the front side 42 for receiving electrical plugs from computers, calculators, and the like. Power cord 30 exits receptacle housing 40 from the back side 44 of housing 40.

Figure 5:
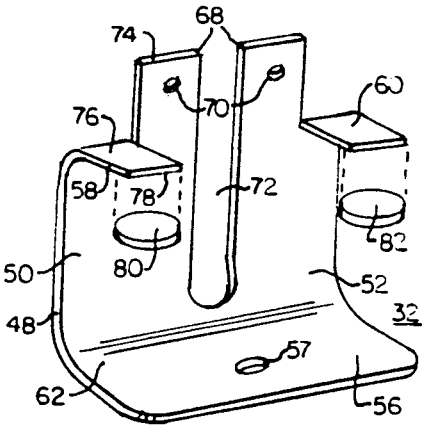
FIG. 5; is a perspective view of a bracket, which is used for both the electrical and communication monuments shown in FIG. 1.

Bracket 32, which is shown in perspective in FIG. 5, is formed from a single metallic sheet 48. Bracket 32 includes an upright back portion 50 having front and back surfaces 52 and 54, respectively, a horizontal base portion 56 having a tapped opening 57, and first and second spaced support arms 58 and 60, respectively, which extend outwardly from the front surface 54 in spaced parallel relation with base portion 56. The horizontal base portion 56 integrally joins the upright back portion 50, from the front surface 52, via a curved section 62 which has a predetermined radius 64, best shown in FIG. 3.

The back portion 50 of bracket 32 extends vertically upward from the curved section 62 to integrally join the first and second spaced support arms 58 and 60, and back portion 50 continues to extend still further in an upward direction between the first and second spaced support arms to define an upstanding mounting flange 68 having spaced holes or openings 70. As illustrated, in a preferred embodiment of the invention, the upstanding mounting flange 68 includes a notch 72 which starts at an upper edge 74 of mounting flange 68 and extends downwardly to the curved section 62. Notch 72 provides an opening for accommodating electrical power cord 30, which depends from the back side 44 of housing 40 and runs along the back surface 54 of bracket 32.

The first and second spaced support arms 58 and 60 have upper and lower sides, such as upper and lower sides 76 and 78 of arm 58, with resilient pads 80 and 82 being fixed to the lower sides of arms 58 and 60.

The predetermined radius 64 of curved section 62 is determined by thickness dimension 20 of work surface 14 and the dimension 26 between the edge 22 along which monuments 10 and 12 are to be mounted and the closest wall or surface 24. In open office plan furniture systems it is common to have cantilever support brackets for supporting work surfaces, such as a support bracket shown in U.S. Pat. No. 3,966,158, which is assigned to the same assignee as the present application. Desk tops or work surfaces may be mounted on such cantilevered supports, for example, by spacing the rear edge from an upright panel to which the support brackets are connected, by a dimension sufficient to enable electrical and communications plugs to be inserted through the resulting opening or space for connection to electrical receptacles and communication ports along the base of the associated panel. Dimension 26 between the back edge 22 of the work surface 14 and the adjoining surface 24 of a support panel, indicated at 26 in FIG. 3, may typically be about three-eights of an inch (0.375"). The thickness dimension 20 of work surface 14 is usually about one inch (1.0") to one and one quarter inch (1.25"). With such dimensions, the predetermined radius 64 may be about seven eights of an inch (0.875").

The communications monument 12 shown in FIG. 1 is similar to electrical monument 10 except communications monument 12 has a receptacle 84 which has openings in a front side 86 for accepting RJ11 and RJ45 connectors, such as connectors 88. Communications monument 12 also has a data cord 90 emanating from a back side 92, instead of a power cord 30, and data cord 90 has a data connector (not shown) at its end instead of a NEMA plug. The bracket and screw of communications monument 12 are identified with the same reference numerals in FIG. 1 as the bracket 32 and screw 34 of the electrical monument 10, since they may be identical.

Both the electrical and communication receptacles 28 and 84, respectively, have tapped openings in the back surface complementary to openings 70 in bracket 32, to receive screws 94, shown in FIG. 4, which enter holes 70 and the tapped openings in the receptacles to firmly fix receptacles 28 and 84 to their associated brackets 32.

The electrical and communications monuments 10 and 12 may be clamped on any edge of a work surface without removing the work surface from its supports. The only requirement is that an edge selected to receive a monument has a minimum clearance of about three-eights of an inch (0.375") between the selected edge and the closest obstruction, such as a rear or side edge of a work surface. The curved section 62 enables the base portion 56, without the screw 34, to be advanced downwardly through this minimum spacing 26, and then a continuing downward plus a rotational movement easily moves the curved section 62 through spacing 26. The resilient pads 80 and 82 rest upon the upper side 16 of work surface 14, and the back portion 50 is moved into contact with the selected edge 22 of the work surface. The threaded shank of screw 34 is then engaged with tapped opening 57 in base portion 56, and using the large knob 36, the screw 34 is manually advanced until the screw point 38 is forced into the lower side 18 of work surface 14. This clamping action of the screw 34 compresses the resilient pads 80 and 82 between the first and second support arms 58 and 60 and the upper side 16 of work surface 14, providing a firm three-point support for monuments 10 and 12 which resists twisting of the monuments when electrical and communications plugs are engaged and disengaged from the openings in the fronts of the receptacles.

Monuments 10 and 12 may be used on work surfaces mounted at any height, and since the monuments are flexible as to location, they may be moved along a selected edge of the work surface until they are directly behind an electronic/data connecting device, to minimize cord clutter on the work surface. The electrical and communications monuments 10 and 12 are compact, and thus do not protrude to any significant extent onto the user's work space, e.g., the receptacles 28 and 84 are about three and one-half inches wide (3.5"), two and one-fourth inches (2.25") high, and seven eights of an inch (0.875") thick, and the bracket 32 has a height dimension, measured between the lower surface of base portion 56 and upper edge 74 of about 2.825". Thus, monuments 10 and 12 may be easily clustered to create power strips or data port strips; appropriate combinations of power and data ports may be provided, as shown in FIG. 1; or, individual monuments of the required type may be placed any where one is required.

We claim:

1. An electrical or communications monument suitable for selective mounting along an edge of a work surface having upper and lower sides, and a predetermined minimum spacing between at least a portion of the edge and an adjacent obstruction, comprising:

a bracket formed from a single metallic sheet, said bracket including an upright back portion having front and back surfaces, a horizontal base portion, and first and second spaced support arms, said horizontal base portion integrally joining the upright back portion, from the front side, via a curved section having a predetermined radius, said first and second spaced support arms extending outwardly from the front side of said upright back portion, in spaced parallel relation with said base portion, said upright back portion extending vertically upward from said curved section to integrally join said first and second spaced support arms, and extending still further in an upward direction between said first and second spaced support arms to define at least one upstanding mounting flange, a receptacle fixed to said at least one upstanding mounting flange, and a screw threadably engaged with the base portion, whereby the bracket may extend about an edge of a work surface such that the first and second support arms contact the upper side of the work surface and said screw contacts the lower side, to firmly secure the monument to the work surface with the resulting three-point engagement.

2. The monument of claim 1 wherein the radius of the curved portion is selected to enable the monument to be mounted along a selected edge of a work surface having a thickness dimension of at least about one inch, when at least a portion of the selected edge is spaced at least about 0.375 inch from an adjacent object, whereby the bracket, without the screw, may be placed in a desired mounting position via a downward rotational action which moves the base portion and curved section, in close proximity to the selected edge, to a position below the lower side of the work surface.

3. The monument of claim 1 wherein the receptacle includes a depending electrical cable, and the upstanding flange has a notch which extends downwardly to the curved section, dividing the upstanding flange into first and second spaced portions to accommodate said depending electrical cable.

4. The monument of claim 3 wherein the depending electrical cable extends along the back side of the upright back portion.

5. The monument of claim 1 including first and second resilient pads fixed to the first and second support arms such that said first and second resilient pads are compressed between the first and second support arms and the upper side of the work surface when the screw is engaged with the lower side of the work surface.

6. The monument of claim 1 wherein the screw has a knob accessible below the base portion for manually turning the screw.

* * * * *